US006279540B1

(12) United States Patent
Greaney et al.

(10) Patent No.: US 6,279,540 B1
(45) Date of Patent: Aug. 28, 2001

(54) CONNECTOR

(75) Inventors: Adrian M Greaney, Sittingbourne; Alan C Green, Maidstone, both of (GB)

(73) Assignee: Lucas Industries plc (GB)

( * ) Notice: Subject to any disclaimer, the term of this patent is extended or adjusted under 35 U.S.C. 154(b) by 0 days.

(21) Appl. No.: 09/357,632

(22) Filed: Jul. 20, 1999

(30) Foreign Application Priority Data

Jul. 24, 1998 (GB) ..... 9816264

(51) Int. Cl.[7] ..... F02M 55/02
(52) U.S. Cl. ..... 123/470; 123/468
(58) Field of Search ..... 123/468, 469, 123/470, 456

(56) References Cited

U.S. PATENT DOCUMENTS

| | | | | |
|---|---|---|---|---|
| 3,431,895 | * | 3/1969 | Bailey | 123/470 |
| 3,845,748 | * | 11/1974 | Eisenberg | 123/470 |
| 3,924,583 | * | 12/1975 | Jardin | 123/470 |
| 4,485,790 | * | 12/1984 | Nishimura et al. | 123/468 |
| 5,365,907 | | 11/1994 | Dietrich et al. . | |
| 5,617,828 | * | 4/1997 | Kuegel et al. | 123/468 |
| 5,775,303 | * | 7/1998 | Sweetland et al. | 123/470 |

FOREIGN PATENT DOCUMENTS

| | | |
|---|---|---|
| 31 28 523 | 2/1983 | (DE) . |
| 195 43 506 | 5/1997 | (DE) . |
| 196 08 574 | 9/1997 | (DE) . |
| 0 569 727 | 11/1993 | (EP) . |
| 925 937 | 5/1963 | (GB) . |

* cited by examiner

*Primary Examiner*—Thomas N. Moulis
(74) *Attorney, Agent, or Firm*—Andrus, Sceales, Starke & Sawall

(57) ABSTRACT

A connector, for example as shown in FIG. 1, for use in supplying fuel to a fuel injector comprises a tubular member arranged to be received, in use, within an opening provided in an engine cylinder head, the tubular member being shaped, at a first end thereof, for cooperation with part of the fuel injector, a second end of the tubular member being shaped for cooperation with an inlet adapter member. The inlet adaptor member is secured, in use, within the opening, the inlet adapter member and the tubular member defining a flow passage whereby fuel can be supplied, under pressure, to the fuel injector.

17 Claims, 2 Drawing Sheets

CONNECTOR

This invention relates to a connector for use in connecting a supply of fuel under high pressure to a fuel injector. In particular, the invention relates to a connector for use in an arrangement of the type in which an injector is located within a bore provided in an engine cylinder head, the fuel being supplied through the cylinder head to the injector.

In a known arrangement an injector is provided with a conical seating, the seating being accessible through a bore or opening provided in the engine cylinder head, the bore extending in a direction substantially parallel to the axis of the seating. A connector is mounted within the bore, the connector including an elongate tubular region which engages the seating provided on the injector. In use, fuel is supplied to the injector through the connector.

Manufacturing tolerances may result in the conical seating and the bore being out of alignment, in which case leakage may occur between the injector and the connector, or the additional stress applied to the connector in order to avoid such leakage may result in premature failure of the connector. It is an object of the invention to provide a connector in which these disadvantages are reduced or avoided.

According to the present invention there is provided a connector for use in supplying fuel to a fuel injector, the connector comprising a tubular member arranged to be received, in use, within an opening provided in an engine cylinder head, the tubular member being shaped, at a first end thereof, for engagement with part of the fuel injector, a second end of the tubular member being shaped for sealing engagement with an inlet adapter member which is secured, in use, within the opening, the inlet adapter and the tubular member defining a flow passage whereby fuel can be supplied, under pressure, to the injector.

Conveniently, the second end of 'the tubular member defines a seating and the inlet adaptor member includes an end region shaped for engagement with the seating.

The connector conveniently includes a filter arranged to manage contaminant particles in the flow of fuel towards the injector. The filter may take the form of an edge filter member located within the inlet adapter member or the tubular member.

Conveniently, the connector includes a seal arrangement whereby the connector is sealed to the cylinder head, the opening and the tubular member defining a fuel flow path whereby fuel at relatively low pressure can be returned from the injector to a low pressure reservoir.

At least one of the inlet adapter member and the tubular member may be provided with a region of part spherical form permitting a degree of articulation between the inlet adapter member and the tubular member.

Figure 1:
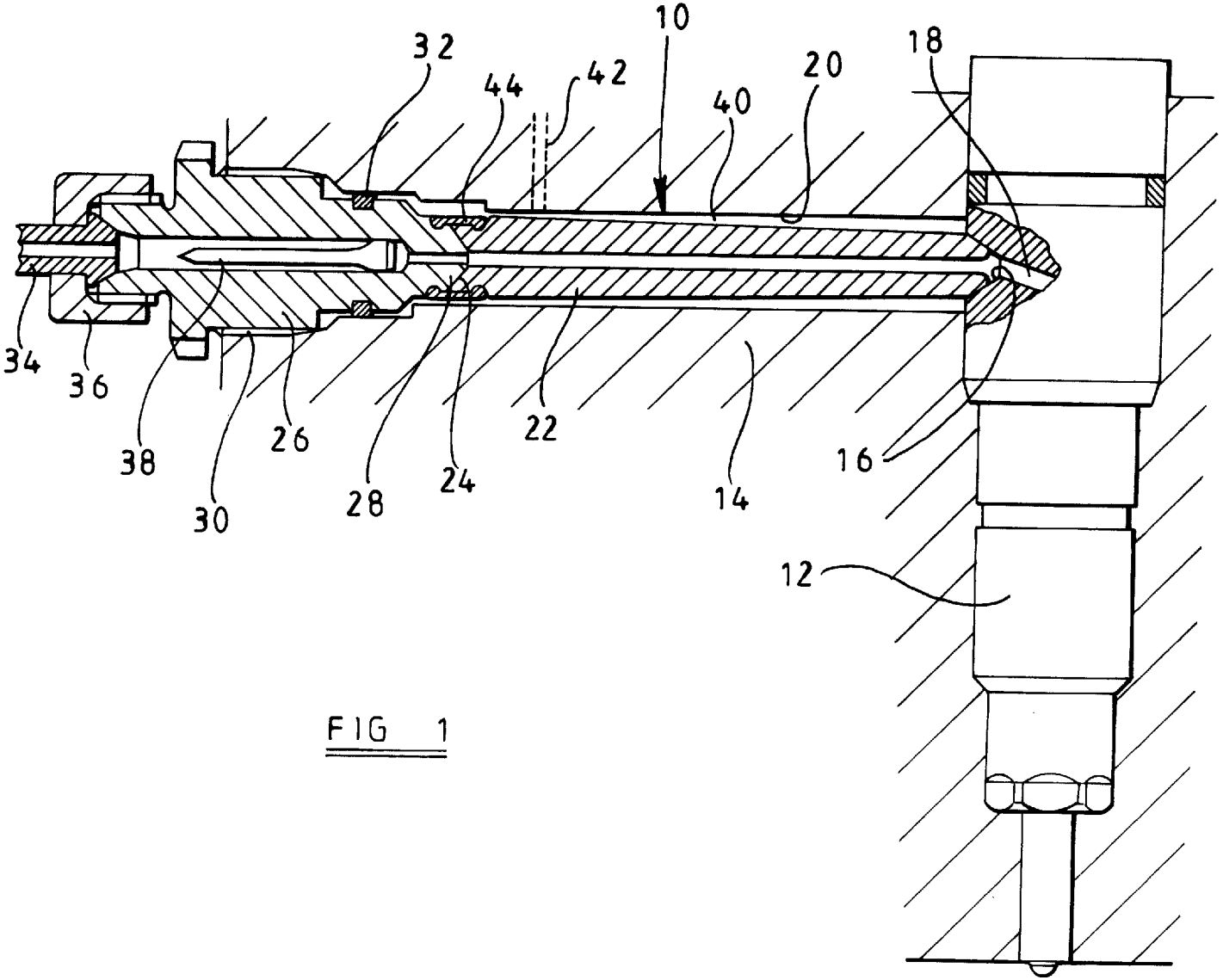
Figure 2:
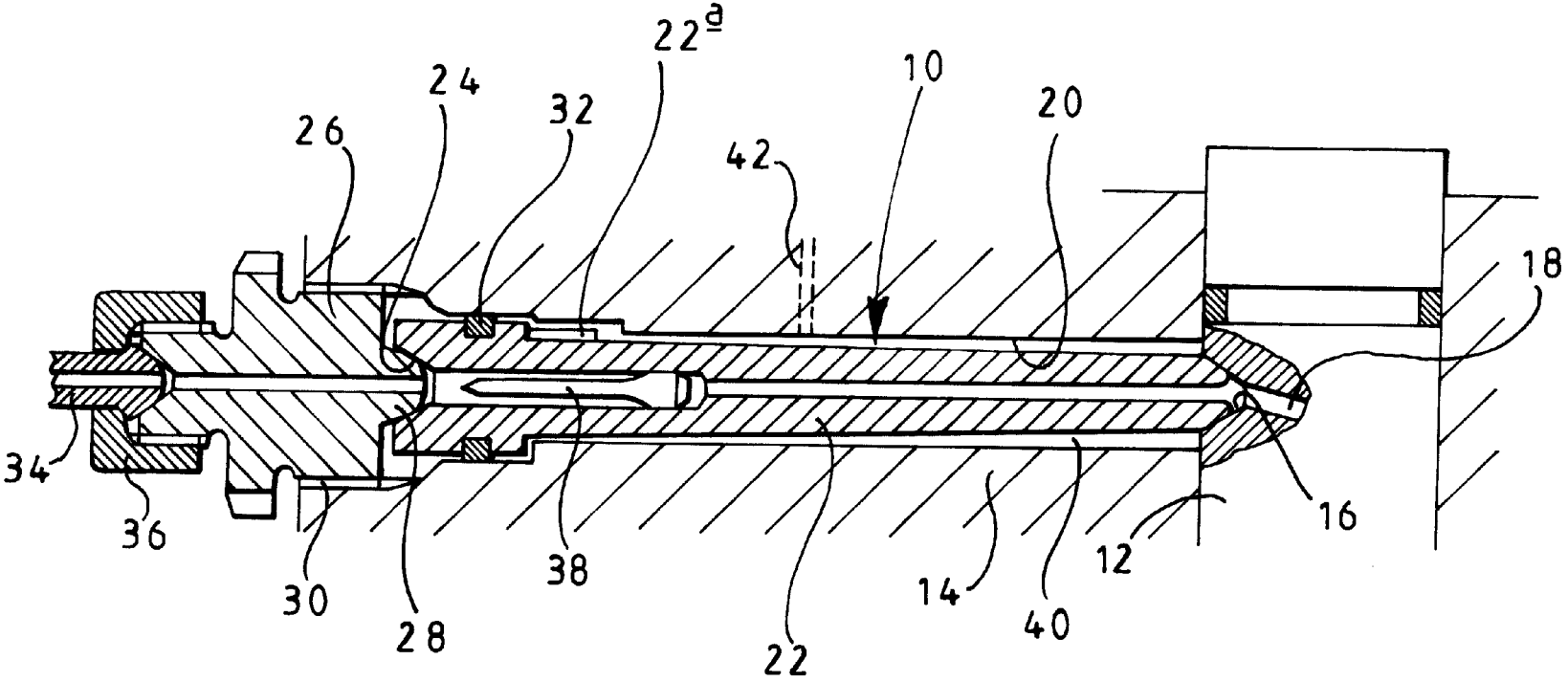

The invention will further be described, by way of example, with reference to the accompanying drawings, in which:

FIG. 1 is a sectional view illustrating a connector in accordance with an embodiment, in use; and FIG. 2 is a view similar to FIG. 1 illustrating an alternative embodiment. FIG. 1 illustrates a connector 10 for use in connecting a supply of fuel to a fuel injector 12 located within a bore formed in a cylinder head 14. The injector 12 is of the type including a seating 16 formed in a side thereof, the seating 16 opening into a fuel supply passage 18 whereby fuel is supplied towards the outlet of the injector 12, in use. The cylinder head 14 is provided with an opening or bore 20 which extends in a direction substantially perpendicular to the axis of the injector 12, the bore 20 being positioned such that, when the injector 12 is correctly located within the cylinder head 14, the seating 16 is accessible through the bore 20.

The connector 10 comprises a tubular member 22 having a first end which is shaped for engagement with the seating 16, and a second end which is shaped to define a frusto-conical seating 24. An inlet adapter 26 is located partially within an end of the bore 20, the inlet adapter 26 including an inner end region 28 shaped for engagement with the seating 24.

The inlet adapter 26 includes an externally screw-threaded region 30 which is arranged to cooperate with screw threads formed in the end region of the bore 20. In use, the inlet adapter 26 is secured within the outer end of the bore 20, the inner end 28 of the inlet adapter 26 engaging the seating 24 of the tubular member 22 and applying a compressive force to the tubular member 22 to form a seal between the tubular member 22 and the seating 16 of the injector and between the inlet adapter 26 and the tubular member 22.

The tubular member 22 and the inlet adapter 26 each include axially extending passages which together define a flow path whereby fuel from a high pressure fuel pipe 34 secured to the inlet adapter 26 by means of a standard pipe fitting 36 is able to flow through the connector 10 to the supply passage 18 of the injector. As illustrated in FIG. 1, the axially extending passage of the inlet adapter 26 includes a region of enlarged diameter which receives an edge filter member 38 arranged to manage particulate contaminants in the flow of fuel towards the injector 12, for example by breaking down such contaminants into debris of an acceptably small size.

The tubular member 22 and the bore 20 together define an annular chamber 40 which, in use, communicates with a low pressure drain chamber (not shown) located between the injector 12 and the bore containing the injector 12 with which drain passages of the injector 12 communicate. Conveniently, the cylinder head 14 includes a passage 42 which communicates with the chamber 40, the passage 42 permitting fuel at low pressure to escape from the injector 12 through the chamber 40 to a low pressure fuel reservoir. Inwardly of the screw-threaded region 30, the inlet adapter 26 includes a recess which locates an annular seal member 32 arranged to form a substantially fluid tight seal between the inlet adapter 26 and the wall of the cylinder head 14 defining the bore 20. It will be appreciated that the provision of the seal member 32 prevents or restricts fuel from escaping from the chamber 40 through the end of the bore 20.

In order to assist assembly, a flexible sleeve 44 is conveniently mounted upon the inner end of the inlet adapter 26, the sleeve 44 receiving part of the second end of the tubular member 22, thus loosely securing the tubular member 22 to the inlet adapter 26. During assembly, once the injector 12 has been located within the cylinder head 14, the assembly of the tubular member 22 and inlet adapter 26 is inserted into the bore 20, and the first end of the tubular member 22 is located to engage the seating 16. The inlet adapter 26 is rotated relative to the cylinder head 14 to apply a compressive load to the tubular member 22 to form seals between the inlet adapter 26 and the tubular member 22 and between the tubular member 22 and the seating 16. It will be appreciated that the sleeve 44 permits articulation between the tubular member 22 and the inlet adapter 26, thus the tubular member 22 need not be coaxial with the inlet adapter 26, the tubular member 22 occupying a position in which compensation for misalignment between the bore 20 and the seating 16 is be achieved.

The arrangement illustrated in FIG. 2 differs from that of FIG. 1 in that the sleeve 44 is omitted, the filter member 38 is located within part of the axially extending passage of the tubular member 22, and the seal member 32 is carried by the tubular member 22 rather than by the inlet adapter 26. During assembly of this arrangement, the injector 12 is located within the cylinder head 14 and the tubular member 22 is inserted into the bore 20. The tubular member 22 includes an outwardly extending tooth or rib 22a which locates within a corresponding recess formed in the bore 20 to restrict angular movement of the tubular member 22 relative to the bore 20. After insertion of the tubular member 22, the inlet adapter 26 is secured in the outer end part of the bore 20, the inlet adapter 26 being rotated relative to the cylinder head to apply a compressive load to the tubular member 22 to form the necessary seals between the tubular member 22 and seating 16 and between the tubular member 22 and the inlet adapter 26.

In both of the embodiments described hereinbefore, the tubular member 22 and the inlet adapter 26 may be constructed from different materials or may be heat treated in different manners to be of different strengths. As a result, plastic deformation of one of these components may occur, improving the seals which must be formed in order to avoid leakage of fuel. For example, the tubular member 22 may be arranged to deform at both the point of engagement between the tubular member 22 and the seating 16 and the point of engagement between the tubular member 22 and the inlet adapter 26. As the tubular member 22 is of relatively simple form, the tubular member 22 may be intended for replacement upon servicing.

It will be apparent that the arrangements illustrated in FIGS. 1 and 2 may be modified, and that such modifications fall within the scope of the invention. For example, the sleeve 44 of the arrangement illustrated in FIG. 1 may be replaced by a suitable spring clip. In the arrangement of FIG. 2, rather than providing a tooth or rib 22a on the tubular member 22, the tubular member 22 may be provided with a recess arranged to align with the recess formed in the bore 20, a steel ball or similar member being located within these recesses to restrict or prevent angular movement of the tubular member 22 within the bore 20.

Although in the illustrated embodiments the bore 20 extends substantially perpendicularly to the axis of the injector, it will be appreciated that this need not be the case and that the invention is also applicable to arrangements in which the bore 20 and the axis of the injector 12 subtend an angle of other than 90°.

What is claimed is:

1. A connector for use in supplying fuel to a fuel injector, said connector comprising a tubular member to be received, in use, within an opening provided in an engine cylinder head, said tubular member having first and second ends, said first end being shaped for cooperation with part of said fuel injector and said second end being shaped for cooperation with an inner end of an inlet adapter member which is secured, in use, within said cylinder head opening; said connector further comprising a flexible sleeve member having first and second ends, said first end of said sleeve member receiving a part of said second end of said tubular member and said second end of said sleeve member receiving a part of said inner end of said inlet adapter member; said inlet adapter member and said tubular member defining a flow passage whereby fuel can be supplied, under pressure, to said fuel injector.

2. A connector as claimed in claim 1, wherein said inlet adapter member is arranged to clamp said tubular member to said fuel injector such that substantially fluid tight seals are formed between said inlet adapter member and said tubular member, and between said tubular member and said fuel injector.

3. A connector as claimed in claim 1, wherein said second end of said tubular member defines a seating and wherein said inlet adapter member includes an end region shaped for engagement with said seating.

4. A connector as claimed in claim 1, wherein one or more of said inlet adapter member and said tubular member is provided with a region of part spherical form permitting a degree of articulation between said inlet adapter member and said tubular member.

5. A connector as claimed in claim 1, further comprising a seal arrangement whereby said connector is sealed to said cylinder head, said cylinder head opening and said tubular member defining a fuel flow path whereby fuel at relatively low pressure can be returned from said fuel injector to a low pressure reservoir for fuel.

6. A connector as claimed in claim 5, wherein said inlet adapter carries an annular seal member arranged to form a substantially fluid tight seal between said inlet adapter member and said cylinder head.

7. A connector as claimed in claim 5, wherein said tubular member includes an outwardly extending part arranged to cooperate with said cylinder head so as to restrict angular movement between said tubular member and said cylinder head.

8. A connector as claimed in claim 1, further comprising a filter arranged to manage contaminant particles in the flow of fuel towards said fuel injector.

9. A connector as claimed in claim 8, wherein said filter comprises an edge filter member located within said inlet adapter member or said tubular member.

10. A connector for use in supplying fuel to a fuel injector, said connector comprising a tubular member to be received, in use, within an opening provided in an engine cylinder head, said tubular member having a first end shaped for cooperation with part of said fuel injector, a second end shaped for cooperation with an inner end of an inlet adapter member which is secured, in use, within said cylinder head opening, and an outwardly extending part arranged to cooperate with said cylinder head so as to restrict angular movement between said tubular member and said cylinder head; said connector further comprising a seal arrangement whereby said connector is sealed to said cylinder head, said cylinder head opening and said tubular member defining a flow path whereby fuel at relatively low pressure can be returned from said fuel injector to a low pressure reservoir for fuel; said inlet adapter member and said tubular member defining a flow passage whereby fuel can be supplied, under pressure, to said fuel injector.

11. A connector as claimed in claim 10, wherein said inlet adapter member is arranged to clamp said tubular member to said fuel injector such that substantially fluid tight seals are formed between said inlet adapter member and said tubular member, and between said tubular member and said fuel injector.

12. A connector as claimed in claim 10, wherein said second end of said tubular member defines a seating and wherein said inlet adapter member includes an end region shaped for engagement with said seating.

13. A connector as claimed in claim 10, wherein one or more of said inlet adapter member and said tubular member is provided with a region of part spherical form permitting a degree of articulation between said inlet adapter member and said tubular member.

14. A connector as claimed in claim 10, wherein said inlet adapter carries an annular seal member arranged to form a substantially fluid tight seal between said inlet adapter member and said cylinder head.

15. A connector as claimed in claim 10, said inlet adapter member having an inner end cooperating with said second end of said tubular member, said connector further comprising a flexible sleeve member having first and second ends, said first end of said sleeve member receiving a part of said second end of said tubular member and said second end of said sleeve member receiving a part of said inner end of said inlet adapter member.

16. A connector as claimed in claim 10, further comprising a filter arranged to manage contaminant particles in the flow of fuel towards said fuel injector.

17. A connector as claimed in claim 16, wherein said filter comprises an edge filter member located within said inlet adapter member or said tubular member.

* * * * *